United States Patent [19]

Pittman et al.

[11] Patent Number: 4,617,774

[45] Date of Patent: Oct. 21, 1986

[54] BUILDING PANEL

[75] Inventors: Raymond H. Pittman, Batavia; William J. Schultz, St. Charles, both of Ill.

[73] Assignee: Masonite Corporation, Chicago, Ill.

[21] Appl. No.: 629,625

[22] Filed: Jul. 11, 1984

[51] Int. Cl.[4] ..... E04D 1/00

[52] U.S. Cl. ..... 52/521; 52/539; 52/546; 52/553

[58] Field of Search ..... 52/519, 529, 530, 531, 52/543-547, 550, 551, 520, 533, 522, 518, 521, 553, 539

[56] References Cited

U.S. PATENT DOCUMENTS

| | | | |
|---|---|---|---|
| Re. 24,246 | 12/1956 | Fink et al. . | |
| 373,373 | 11/1887 | Montross . | |
| 2,264,546 | 12/1941 | Ochs . | |
| 2,568,603 | 9/1951 | Anthony | 52/544 |
| 3,248,835 | 5/1966 | Westlind | 52/529 X |
| 3,333,384 | 8/1967 | Brady . | |
| 3,394,520 | 7/1968 | Skelton, Jr. | 52/531 X |
| 3,626,439 | 12/1971 | Kneisel . | |
| 3,643,394 | 2/1972 | Johnson . | |
| 3,702,031 | 3/1973 | Wilson et al. . | |
| 3,703,795 | 11/1972 | Mattes . | |
| 3,796,586 | 3/1974 | Hanlon et al. . | |
| 3,848,383 | 11/1974 | Wilson et al. . | |
| 3,848,384 | 11/1974 | Eaton et al. . | |
| 3,852,933 | 12/1974 | Guzzo | 52/537 X |
| 3,852,934 | 12/1974 | Kirkhuff . | |
| 3,868,300 | 2/1975 | Wheeler . | |
| 3,897,667 | 8/1975 | Turek . | |
| 3,899,855 | 8/1975 | Gadsby . | |
| 3,927,501 | 12/1975 | Allen et al. . | |
| 3,943,677 | 3/1976 | Carothers . | |
| 4,061,813 | 12/1977 | Geimer et al. . | |
| 4,065,899 | 1/1978 | Kirkhuff . | |
| 4,102,106 | 7/1978 | Golder et al. | 52/546 X |
| 4,188,762 | 2/1980 | Tellman . | |
| 4,223,490 | 9/1980 | Medow | 52/546 X |
| 4,258,520 | 3/1981 | Rehbein | 52/522 |
| 4,261,152 | 4/1981 | Tellman . | |
| 4,266,382 | 5/1981 | Tellman . | |
| 4,279,106 | 7/1981 | Gleason et al. . | |
| 4,366,197 | 12/1982 | Hanlon et al. . | |

FOREIGN PATENT DOCUMENTS

| | | | |
|---|---|---|---|
| 639913 | 3/1964 | Belgium | 52/550 |
| 245195 | 3/1912 | Fed. Rep. of Germany | 52/545 |

*Primary Examiner*—John E. Murtagh
*Assistant Examiner*—Richard Chilcot
*Attorney, Agent, or Firm*—Mason, Kolehmainen, Rathburn & Wyss

[57] ABSTRACT

A building panel for exterior and interior wall and roof surface includes an elongated body formed of a relatively thin walled, molded hardboard material having upper and lower edges, opposite ends, an outer weather face adapted to resemble the profiles historical or traditional siding and shingle shapes and a back face generally contoured to match the outer surface. The body includes a lower edge portion extending upwardly and outwardly of the lower edge of the panel which joins an intermediate fascia portion spaced outwardly of the lower edge. An elongated fastener receiving strip is formed along an upper edge of the intermediate fascia portion and includes a plurality of longitudinally spaced apart fastener receiving depressions integrally molded therein. The strip has a machined back face and the machine cut intersects an outer face of the panel around the depressions thereby forming an open slot extending completely through the panel in each depression for receiving a fastener shank for securing the building panel on a building structure. An upper edge portion of the panel joins an upper edge of the fastener receiving strip and includes an upwardly and outwardly extending first segment adapted to underlie a lower edge portion of a panel laid up in a next higher course in a building wall structure. The upper edge portion also includes a second segment which extends between the first segment and the upper edge of the panel, generally parallel of the intermediate fascia portion and adapted to underlie a portion of the fascia portion of the panel laid up in the next higher course.

14 Claims, 3 Drawing Figures

FIG. 2
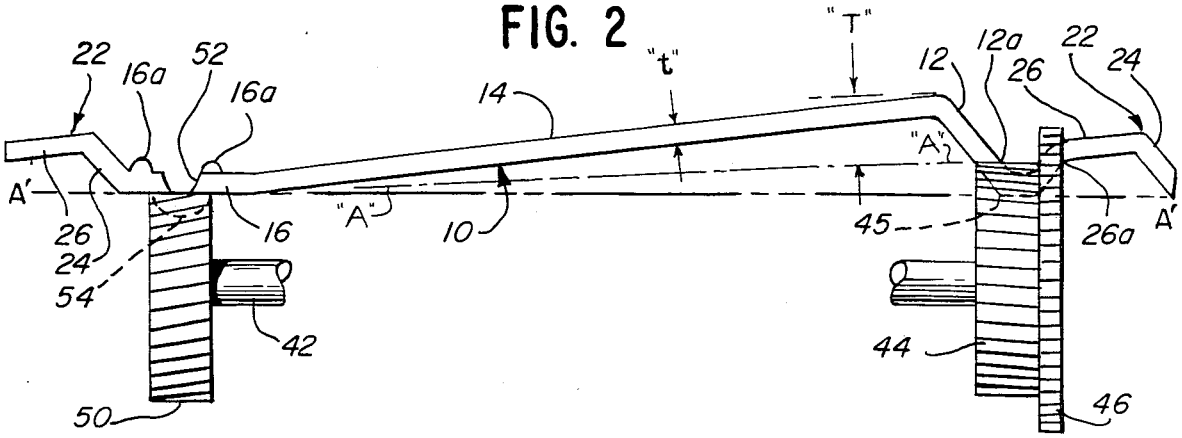
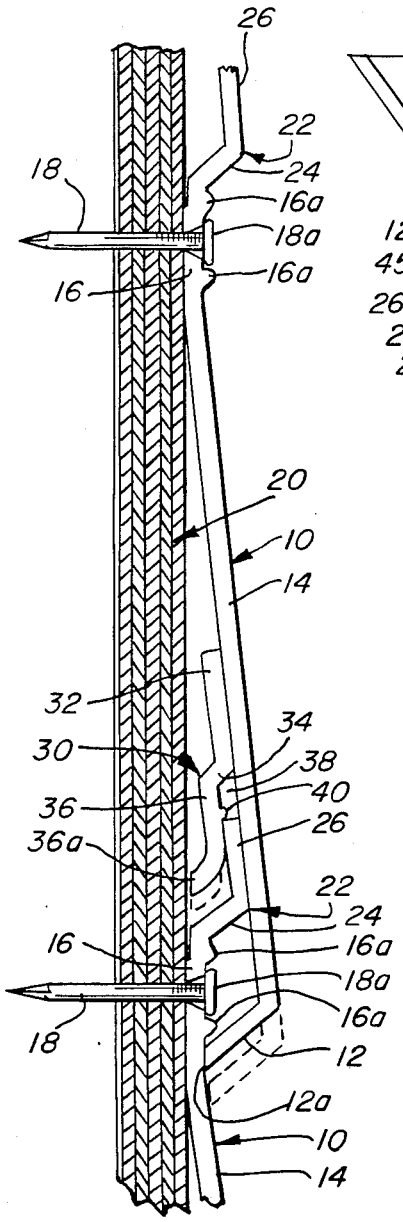
FIG. 3
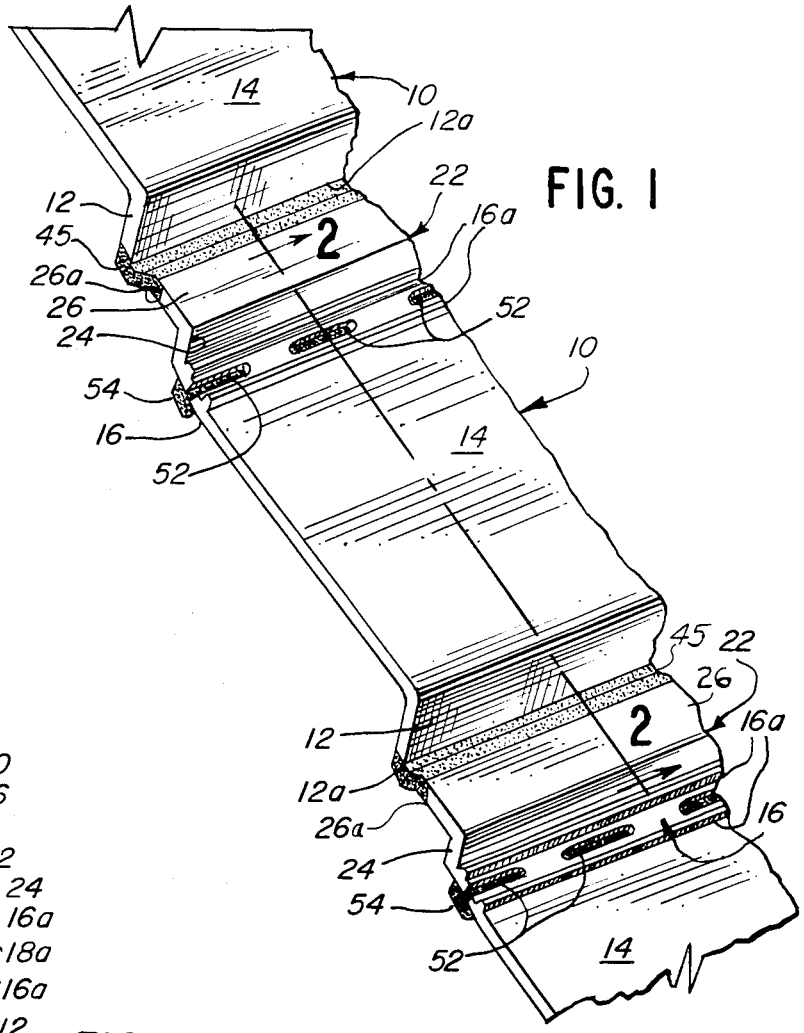
FIG. 1

BUILDING PANEL

BACKGROUND OF THE INVENTION

1. Field of the Invention

The present invention relates to building panels for exterior and interior wall and roof surfaces of a building structure and more particularly, comprises a building panel formed of relatively thin walled, molded hardboard having an outer weather face designed to resemble historical or traditional siding material such as lap siding, drop siding, shingles and shakes, etc.

2. Brief Description of the Prior Art

Over the years, a wide variety of siding and roofing profiles have been developed both in wood, asphalt or mineral based materials as well as aluminum and vinyl. In general, man-made materials have sought to replicate or copy the external appearance of historical or traditional wood products. The following U.S. patents have been issued relating to building wall and roof siding, paneling and shingle products:

| | | | |
|---|---|---|---|
| Fink et al | RE. 24,246 | Turek | 3,897,667 |
| Montross | 373,373 | Gadsby | 3,899,855 |
| Ochs | 2,264,546 | Carothers | 3,943,677 |
| Brady | 3,333,384 | Allen et al | 4,366,197 |
| Kneisel | 3,326,493 | Eaton | 4,015,392 |
| Johnson | 3,643,394 | Geimer et al | 4,061,813 |
| Mattes | 3,703,795 | Kirkhuff | 4,065,899 |
| Wilson et al | 3,720,031 | Golder et al | 4,102,106 |
| Hanlon et al | 3,796,586 | Tellman | 4,188,762 |
| Wilson et al | 3,848,383 | Tellman | 4,261,152 |
| Eaton et al | 3,848,384 | Tellman | 4,266,382 |
| Kirkhuff | 3,852,934 | Gleason et al | 4,279,106 |
| Wheeler | 3,868,300 | Hanlon et al | 4,366,197 |

OBJECTS OF THE INVENTION

An object of the present invention is to provide a new and improved building panel for exterior and interior wall and roof surface of building structures, more particularly a panel having an elongated body formed of relatively thin, molded hardboard.

It is an object of the present invention to provide a building panel of the character described which may be molded into intricate profiles or shapes to closely resemble historical and traditional profiles of wood products used for siding and roofing on houses and the like.

Yet another object of the present invention is to provide a new and improved building panel of the character described which is especially designed to provide a much greater surface area coverage but with a much lower weight of material being required per unit area covered.

Still another object of the present invention is to provide and new and improved building panel of the character described which has a new and unique system and method for providing nail or fastener slots therein adapted to receive nails or other fastener shanks used for securing the panels in place on a wall or roof structure.

Still another object of the present invention is to provide a new and improved building panel of the character described adapted to be laid up or applied in overlapping courses or rows and provided with means permitting individual panels to expand and contract without encountering serious problems such as buckling, cracking, splitting or weather leakage.

Yet another object of the present invention is to provide a new and improved building panel of the character described which may be economically produced and which is easily handled and capable of rapid and easy installation, even by unskilled artisans on a wide variety of different types of building wall and roof structures.

Yet another object of the present invention is to provide a new and improved building panel or lap siding product formed of molded, thin-walled, hardboard material which is self-aligning during installation and which panel facilitates the installation thereof by providing elongated fastener receiving slots therein intermediate the upper and lower edges of the panel.

Yet another object of the present invention is to provide a new and improved building panel of the character described which has greatly improved resistance against wind uplift forces and which provides an excellent outer weather seal and surfacing for a building wall or roof structure, yet still permits individual panels to expand and contract in response to the level of moisture contained therein and the temperature changes encountered.

Another object of the invention is to provide a new and improved building panel of the character described having an elongated fastener receiving strip adjacent an upper edge including a plurality of longitudinally spaced apart, fastener receiving depressions which are integrally formed therein initially in the molding process and then are completed by machining a back face of the panels so as to open up nailing slots which extend completely through the panel body between inner and outer faces of the panel.

Yet another object of the present invention is to provide a new and improved method of making an elongated fastener receiving strip portion in a thin-walled, molded hardboard building panel which provides a plurality of open slots at longitudinally spaced intervals therein a row for receiving fasteners used for application of the panels onto a building wall or roof structure.

SUMMARY OF THE INVENTION

The foregoing and other objects and advantages of the present invention are accomplished in an embodiment comprising a new and improved building panel for exterior and interior wall and roof surfaces having an elongated body formed of relatively thin, molded hardboard material having upper and lower edges, opposite ends, an outer weather face molded and embossed to resemble historical and traditional siding and/or roofing profiles and a contoured back face generally following the variations in the outer weather face thereof. The body of the panel includes a lower edge portion extending upwardly and outwardly of the lower edge of the panel which joins an intermediate fascia portion which is spaced outwardly of the lower edge. An elongated fastener receiving strip is formed along an upper edge of the intermediate fascia portion of the panel and the fastener strip includes a plurality of longitudinally spaced apart, fastener receiving, integrally molded depressions. After molding, the strip is machined along a back face of the panel to a depth intersecting the depressions which protrude from the back face of the panel. The machining operation removes the protrusions to cut open and define a plurality of open slots, which slots extend completely through the panel to form elongated nail holes or slots for receiving the shanks of nails or other fasteners used for securing the building panels to a wall or roof structure. Above the fastener receiving strip, the panel is provided with an upper edge portion which includes an upwardly and outwardly extending first segment adapted to underlie a lower edge portion of a panel(s) laid up in a next higher course, and an upper second segment which forms the upper edge of the panel.

BRIEF DESCRIPTION OF THE DRAWING

For a better understanding of the present invention, reference should be had to the following detailed description taken in conjunction with the drawing in which:

FIG. 1 is a fragmentary front elevational view of a new and improved panel constructed in accordance with the features of the present invention and shown after a panel has been molded in a large blank containing several panels but has not yet been separated into individual panels therefrom;

FIG. 2 is a transverse cross sectional view of a panel in accordance with the present invention and illustrated in graphic form, a machining operation used for trimming the edges of the panel blank and for forming elongated nail or fastener slots in a fastener receiving strip portion thereof by machining off protrusions on the panel back face to form a row of open holes, and;

FIG. 3 is a fragmentary, vertical cross-sectional view of a building wall structure showing panels in accordance with the present invention after installation thereof.

DESCRIPTION OF THE PREFERRED EMBODIMENT

Referring now more particularly to the drawings, building panels 10 in accordance with the invention are formed of a thin-wall, molded hardboard material in a press, generally of the type shown in U.S. Pat. No. 1,923,548. Panel blanks of the desired profile are molded between pairs of upper and lower press plates, which plates are shaped and designed to form the relatively intricate profile and surface as illustrated in FIG. 1. The press plates may be as large as 4'×16' and in accordance with the present invention, panel blanks a of molded configuration as shown in FIG. 1 may contain four or more panels 10 which are nominally 12" wide by 16' long. Each panel has an intrically molded transverse profile designed to replicate and simulate historical or traditional profiles of wood lap siding or drop siding.

Each panel 10 is formed with a lower edge portion 12 sloping upwardly and outwardly from a lower edge 12*a* at an obtuse angle from a back plane "A—A" of the panel defined to extend between said lower edge and a back surface portion of the panel spaced upwardly of the back plane as represented by the line "A—A" in FIG. 2. The panel wall has an approximate thickness "t" of ⅛th" but the panel 10 as a whole has an overall maximum depth or thickness "T" (FIG. 2) between the back plane and an outer face thereof which is considerably larger (κ" to ¾") than the relatively thin wall thickness "t" of the molded hardboard material.

At the upper and outer edge, the lower edge portion 12 integrally joins the lower edge of a relatively flat, intermediate fascia portion 14 at an obtuse angle and the fascia portion may contain at least one or a plurality of lap siding elements, integrally joined by one or more butt edge portions parallel of the lower edge portion 12. While a single lap configuration is illustrated, the panels 10 may be of a multi-lap configuration having several narrower laps if desired. At the upper edge, the fascia portion integrally joins a narrow, fastener receiving strip 16 having a pair of outwardly projecting, longitudinally extending, parallel guide ribs 16*a* along the upper and lower edges thereof. The guide ribs 16*a* are adapted to accommodate the heads 18*a* of a nail 18 or other type of fasteners used for securing the strip 16 of the panels 10 to a building wall or roof structure 20 as the panels are applied on a building.

Along the upper edge, each panel is provided with an upper edge portion 22 having a lower segment 24 integrally joining the fastener strip 16 and projecting upwardly and outwardly thereof at an obtuse angle. The upper edge portion also includes an upper edge segment 26 joining the lower segment 24 and lying in a plane generally parallel to the intermediate fascia portion 14 of the panel.

As best illustrated in FIG. 3, the upper edge portion 22 is adapted to underlie a lower portion of the fascia 14 of a panel or panels in a next higher course or row, and the upper segment 26 is adapted to slidably engage and/or face the back side of the fascia portion 14 of a next higher panel(s).

In accordance with the present invention, each panel 10 is provided with a fastening or interlocking joint strip 30 formed of molded hardboard material and having an upper edge portion 32 secured to the back side of the panel fascia 14 with adhesive or other appropriate securing means. The joining strip 30 is mounted near a lower edge of the fascia portion and includes an angularly offset portion 34 and a lower portion 36 having a curved lower end portions 36*a* flared outwardly away from the back side of the adjacent fascia portion 14. The curved lower end portion of the strip provides guidance for interlocking the strip 30 with the upper edge segment 26 along the upper edge portion of a lower panel when successive panels are laid up or positioned on a building wall or roof surface. The lower segment 36 of the joining strip is spaced apart from the back surface of the panel fascia 14 to define an open area or slot 38 (FIG. 3) for slidably receiving the tongue-like, upper edge segment 36 of a panel in the prior course as succesive panels are installed.

In order to properly space and self-align the panels upon each other in slidable but interlocking relation between successive courses, the lower portion 36 of the joining strip 30 is formed with a small, outwardly extending, integral spacer rib 40 which butts or engages the upper edge of the upper segment 26 in the next lower panel to provide automatic self alignment during installation. The rib 40 has a relatively small, transverse cross section so that should the panel dimensions change substantially after initial installation, the sharp upper edge surface of the segment 26 of a lower panel may shear off or severe the rib 40 from the remaining portion of the joining strip 30 and thereafter the interlocking panel edge and joining strip can move relative to one another without substantial interference or buckling forces being generated.

Expansion and contraction of panels is caused because of subsequent absorption and desorption of moisture and other weather factors. Thus, the rib 40 serves as a spacer during initial installation and thereafter may be fractured or severed away so as not to interfere with free relative sliding movement between the interlocking upper edge segment 26 on a lower panel and the lower edge 36 of the joining strip 30 of an interlocking higher panel. The interlocking relationship thus formed between panels laid up in succession is a floating type joint or interconnection which accommodates relative expansion and contraction of both the upper and lower interlocked panel portions. Such expansion and contraction is often encountered because of moisture absorption and desorption, and the slipjoint interconnection permits free movement of the panel segments without cracking or buckling, and permits such movement while still retaining a positive interlocking relation. Thus buckling, bending or other damage to the relatively thin-walled, panel members is avoided.

As illustrated in FIG. 3 in dotted lines, the lower end portion of a panel including a joining strip 30 on the inside surface or back face of the fascia portion 14 may tend to expand and move downwardly relative to a next lower panel by an amount somewhat dependent on the moisture absorbed since originally installed. This expansion can result in a shearing off of the small rib 40 which has a relatively small cross-section. After shearing of the rib 40 has occurred, further downward relative movement between the lower facia portions of the upper panels and the relatively fixed, upper edge portions of the lower panels is readily accommodated without resulting in built-up stresses between the interlocked rows or courses of panel members on a wall or roof. In addition, the positive interlocking relationship between the joining strips 30 on upper panels and the upper edge segments 26 on adjacent lower panels is continuously maintained to provide a secure and positive interlock between successive panel courses at all times after initial installation is completed.

The panels 10 are applied or installed on a building wall or roof with spaced apart fasteners such as nails 18 or other fasteners that are driven into the fastener strip 16 of each panel through elongated nail slots 52 provided at approprimate intervals between the ribs 16*a*. The nail receiving strip is located adjacent an upper edge portion of the panel and this portion is subsequently interlocked to the next upper panel applied on the building wall.

In accordance with the present invention, a panel blank containing a plurality of panels 10 (usually 4, 6 or 8) like that shown in cross-section in FIG. 1 is machined or cut to the separate individual panels from adjacent panels in the blank. This separation is accomplished as illustrated in FIG. 2 with a rotary saw or cutter mechanism like a table saw and the cutters are mounted on an arbor shaft 42 which is rotationally driven by a suitable power unit. The saw may have a planar work surface or a plurality of rolls which act a table or horizontal supporting surface as illustrated by the dashed line "A'—A'". A lower edge portion or surface 12*a* of a panel edge is cut away and edge trimmed by movement of a panel blank in a single longitudinal pass over a first saw or cutter 44. This cutter removes a strip of material labelled 45 from the back or underside of the multipanel molded blank. The cutter 44 provides a neatly cut, sharply trimmed edge 12*a* at the lower edge portion 12 of one panel and a similar sharp and neatly trimmed upper edge segment 26*a* at the upper edge portion 22 of the adjacent panel in the blank while severing the blank into two separate pieces at one time on a single pass. An upper edge 26*a* of the panels is cut or trimmed by a second saw or cutter 46 having a slightly greater diameter and this cutter produces true and straight trimmed edges 12*a* and 26*a* as the individual panels 10 are separated from a larger blank containing several such panels.

In accordance with an important feature of the present invention, yet another saw or back cutter 50 is mounted on the same arbor shaft 42 in order to trim and face the back surface of the fastener strip portion 16 of the panels 10. The back face trimming cut simultaneously produces a plurality of elongated, longitudinally spaced apart, fastener receiving holes or slots 52 in the fastener strip section 16 of the panels between the spaced apart, parallel ridges 16*a*.

The molds or press plates that are used in forming the large panel blanks (containing several molded panels 10) are provided with appropriately shaped positive mold projections on the upper mold plate which forms the outer panel faces and these projections are generally matched or mated to cooperate with somewhat larger sized, similarly shaped recesses provided on the lower or bottom plate. When the upper and lower plates are closed during a pressing operation, a plurality of protruding mounds or bosses 54 of molded hardboard are formed in the panel blank at longitudinal intervals in a row on the back face of each panel strip portion 16. The cooperating press plate surfaces provide a continuous shell of molded material between the upper or inside surfaces of the elongated openings 52 and the back face of the panel blank. These protruding bosses or projections 54 are subsequently removed and machined away or trimmed off from the back side of the panel blanks by the cutter or saw 50 as the panel blanks move in a single pass over the arbor shaft. The cutter action in removing the rearwardly protruding mounds of material 54 results in the formation of clean cut elongated, slotted nail opening 52 at appropriate longitudinal intervals along the panel strip portion 16. At the same time, the back face of the strip portion 16 is smoothly surfaced or planed away ready to abutt a building wall surface when the panels are installed (FIG. 3).

The nail slots 52 are located at appropriately spaced intervals along the fastener strip portion 16 of each panel and are adapted to guide the reception and installation of fasteners such as nails, staples, screws etc. or other types of suitable fasteners, which may be applied with a hammer or with an automatic fastener driving tool or gun. In the latter case, the ribs 16*a* in cooperation with the elongated slots 52 provide guidance for a workman in positioning the nose or drive track of a tool in the desired position along the center of the fastener strip 16 of a panel for securing the panel in place on a building wall or roof structure.

The novel method of forming the nail slots 52 which comprise apertures extending completely through the panel thickness is achieved by first providing recesses in the front side of the panels resulting in molded projections 54 on the backside. Subsequently these projections are machined away and removed from the back face resulting in the formation of the nail slots. The panels are trimmed and surfaced in a single longitudinal pass of a panel blank over the arbor shaft and a sequential operation of punching, slotting or drilling with repetitive, punch press type operations heretofore used when forming fastener receiving slots is eliminated. This new and unique process greatly contributes to the overall economy of manufacture of the molded panels 10 in accordance with the present invention.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. A building panel for exterior and interior wall and roof surfaces comprising:

an elongated body formed of relatively thins, hardboard material, having upper and lower edges, a molded outer face adapted for exposure to the weather, and a back face opposite said outer face and having contour generally matching that of said outer face;

said body including a lower edge portion extending along a lower edge of said panel integrally joining an intermediate facia portion spaced outwardly of said lower edge;

an elongated fastener receiving strip integrally joining an upper edge of said intermediate facia portion and including a plurality of longitudinally spaced apart, integrally molded, fastener receiving depressions projecting inwardly from the intersecting surface of said outer face immediately adjacent an edge of said depressions, each of said depressions having an inwardly sloping wall surface with a depth greater than the nominal thickness of said panel between said outer face and said back face, said depressions aligned in a row on said strip between said upper and lower edge of said panel, said strip having a machined back surface comprising a portion of said panel back face formed by machining after said depressions have been formed in said panel, said machined back surface having a generally planar face intersecting said sloping wall surface of each depression thereby forming an open slot for receiving a fastener extending completely through said panel between said outer and back faces thereof; and an upper edge portion joining an upper edge of said fastener receiving strip adapted to underlie a lower edge portion of a panel laid up in a next higher course.

2. The building panel of claim 1 wherein said fastener receiving strip includes a plurality of outwardly projecting parallel ribs on opposite sides of said row of nail slots for guiding the installation of fasteners used for securing said panel on a building surface.

3. The building panel of claim 2 wherein said panel body has a thickness between said outer face and said back face that is substantially less than an overall panel thickness measured between a back plane extending between said machined back face and said lower edge and a portion on said outer face of said panel.

4. The building panel of claim 1 including a joining strip on said back face adjacent a lower segment of said intermediate facia portion, said joining strip adapted to provide an elongated continuing interlocking relation with said upper edge portion of at least one panel in an adjacent lower course.

5. The building panel of claim 1 wherein said joining strip includes a lower portion spaced apart from said base face of said intermediate facia portion creating a space therebetween for receiving said upper edge portion of said one panel in an adjacent lower course.

6. The building panel of claim 5 wherein said lower portion of said joining strip includes a lower edge flared outwardly of said back panel of said intermediate facia portion for guiding said panel into interlocking relation with said upper edge portion of said one panel in an adjacent lower course upon movement of said joining strip toward the same.

7. A building panel for exterior and interior wall and roof surfaces, comprising:

an elongated body formed of relatively thin, hardboard material, having upper and lower edges, a molded outer face adapted for exposure to the weather, and a back face opposite said outer face and having a contour generally matching that of said outer face;

said body including a lower edge portion extending along a lower edge of said panel integrally joining an intermedia facia portion spaced outwardly of said lower edge;

an elongated fastener receiving strip integrally joining an upper edge of said intermediate facia portion and including a plurality of longitudinally spaced apart, integrally molded fastener receiving depressions projecting inwardly from the intersecting surface of said outer face immediately adjacent an edge of said depressions, each of said depressions having an inwardly sloping wall surface with a depth greater than the nominal thickness of said panel between said outer face and said back face, said depressions aligned in a row on said strip between said upper and lower edge of said panel, said strip having a machined back surface comprising a portion of said panel back face formed by machining after said depressions have been formed in said panel, said machined bakc surface having a generally planar face intersecting said sloping wall surface of said depressions thereby forming an open slot for receiving a fastener extending completely through said panel between said outer and back faces thereof;

an upper edge portion joining an upper edge of said fastener receiving strip adapted to underlie a lower edge portion of a panel laid up in a next higher course;

a joining strip on said back face adjacent a lower segment of said intermediate facia portion, said joining strip adapted to provide an interlocking relation with said upper edge portion of at least one panel in adjacent lower course; and stop means on said joining strip for self-alignment of said panel with said one panel in an adjacent lower course when said panels are installed in interlocking relation.

8. The building panel of claim 7 wherein said stop means includes an elongated rib projecting from said joining strip toward said back face of said intermediate facia position for engagement with said upper edge of said one panel.

9. The building panel of claim 8 wherein said rib has a relatively small transverse cross-section and is shearable from said joining strip to permit relative sliding movement between said panels while in said interlocking relation.

10. A panel adapted to be attached to a supporting structure with at least one fastener extending through the thickness of said panel;

a depression molded into one face of said panel having a plurality of wall surfaces extending inwardly and sloping toward the opposite face, at least a portion of said wall surfaces having a depth greater than the normal thickness of said panel measured at an area immediately adjacent said depression directly between said opposite faces, a machined surface formed on said molded depressions having a generally planar surface intersecting said wall surface of said depression thereby forming an open slot extending completely through the thickness of said panel for receiving a fastener, said plurality of wall surfaces disposed on opposite sides of said slot sloping inwardly of adjacent flanking portions of said outer face toward one another toward said back face.

11. The panel of claim 10 wherein said panel includes a plurality of said depressions molded in said outer face at spaced intervals along a row and wherein said machined surface comprises an elongated planar strip aligned with said row on said opposite face of said panel.

12. The panel of claim 11 wherein said depressions are elongated in shape having a major axis along said row.

13. The panel of claim 10 wherein said opposite side surface of said depression are interconnected by rounded opposite end surfaces.

14. The panel of claim 13 wherein said opposite side surfaces of said depression comprise opposite sides of an elongated slot.

* * * * *